US005888018A

United States Patent [19]

Green

[11] Patent Number: 5,888,018

[45] Date of Patent: Mar. 30, 1999

[54] GLUE DISPENSER FOR INSTALLING RAISED ROAD MARKERS

[75] Inventor: John L. Green, Sedro Woolley, Wash.

[73] Assignee: Accrued, Inc., Olympia, Wash.

[21] Appl. No.: 912,062

[22] Filed: Aug. 15, 1997

Related U.S. Application Data

[63] Continuation-in-part of Ser. No. 698,427, Aug. 15, 1996.

[51] Int. Cl.[6] ..... E01C 23/18

[52] U.S. Cl. ..... 404/94; 222/135; 222/146.2; 222/482; 239/124; 239/135

[58] Field of Search ..... 404/73, 75, 79, 404/93, 94, 95, 83, 84.05; 222/135, 146.2, 482, 548; 239/124, 135, 548, 550, 551, 562

[56] References Cited

U.S. PATENT DOCUMENTS

| | | | |
|---|---|---|---|
| 3,540,358 | 11/1970 | Oakley | 94/39 |
| 3,590,701 | 7/1971 | Ten Broeck | 94/39 |
| 3,864,052 | 2/1975 | Blomberg | 404/94 |
| 4,369,001 | 1/1983 | Eigenmann | 404/94 |
| 4,373,670 | 2/1983 | Kilner | 239/172 |
| 4,792,259 | 12/1988 | Eigenmann | 404/73 |
| 4,936,485 | 6/1990 | Downing | 221/297 |
| 4,974,990 | 12/1990 | Anderson et al. | 404/94 |
| 5,054,959 | 10/1991 | Wilson et al. | 404/94 |

OTHER PUBLICATIONS

Report: "Automated Raised Pavement Marker Machine (Conveyor System)", University of California (Jun. 30, 1992).

Report: "An Investigation of New Marker Adhesive Processes for Botts' Dots", University of California, California DOT (Mar. 31, 1995).

Application: "Telerobotic Pavement Marker Application", L. Bernold, North Carolina State University, Mar. 1996.

*Primary Examiner*—James A. Lisehora
*Attorney, Agent, or Firm*—Joan H. Pauly

[57] ABSTRACT

A glue dispenser is mountable on a vehicle as part of apparatus for installing raised road markers on a roadway. Preferably, the apparatus is used in a system for automated installation of road markers. The dispenser includes a manifold having an inlet for glue fed downwardly into the manifold from a glue reservoir mounted on the vehicle. First and second glue outlets communicate with the inlet. First and second valves control opening and closing of the first and second outlets, respectively. The valves are operable both simultaneously and independently of each other to permit glue to be dispensed from only of the outlets or from both of the outlets simultaneously, as needed. The outlets are spaced apart a distance equal to a desired distance between lines of markers in a double line installation.

13 Claims, 5 Drawing Sheets

GLUE DISPENSER FOR INSTALLING RAISED ROAD MARKERS

RELATED APPLICATION

This application is a continuation-in-part of application Ser. No. 08/698,427, filed Aug. 15, 1996, and entitled, "System for Installing Raised Road Markers and Marker for Use in Same".

TECHNICAL FIELD

This invention relates to apparatus for installing raised road markers on a roadway and, more particularly, to a glue dispenser having dual outlets spaced to allow simultaneous installation of a double line of markers or installation of a selected single line of markers.

BACKGROUND OF THE INVENTION

The systems currently in use for installing raised road markers on a roadway have a number of serious drawbacks. These drawbacks include high labor requirements and thus high labor costs, slow speed of installation and consequent low productivity, and especially worker safety concerns. One of the primary sources of concerns for worker safety is the necessity of having a worker stationed in a position relatively exposed to traffic. The installation procedures currently in use are not automated or are incompletely automated. Therefore, a worker is commonly placed in a position adjacent to the roadway to permit the worker to manually place adhesive and/or markers onto the roadway. If, as commonly is the case, the roadway is not closed to traffic, traffic passes in close proximity to the worker. When hot melt adhesives are used, the worker is also subjected to the hazard of handling high temperature materials. In addition, the lack of automation is not conducive to accurate installation of markers because of the vulnerability of the procedures to human error.

SUMMARY OF THE INVENTION

The present invention is directed toward a glue dispenser for use in apparatus for installing raised road markers on a roadway. According to an aspect of the invention, the dispenser comprises a manifold having an inlet for glue and first and second outlets communicating with the inlet. First and second valves control opening and closing of the first and second outlets, respectively. The valves are operable both simultaneously and independently of each other to permit glue to be dispensed from only one of the outlets or from both of the outlets simultaneously, as needed. The outlets are spaced apart a distance equal to a desired distance between lines of markers in a double line installation.

The dispenser may be used for dispensing various types of adhesives. It is presently anticipated that the adhesive used will typically be a hot melt bitumen adhesive. When the dispenser is used to dispense this type of adhesive or some other adhesive that is required to be at an elevated temperature for installation, the dispenser preferably includes means for maintaining glue in the manifold within a predetermined range of elevated temperatures. The means used may, for example, be a hot oil jacket, electrical heating tape, or the like.

In the currently most preferred embodiment of the invention, the manifold inlet is connectable to a glue reservoir remote from the manifold. The manifold has a third outlet communicating with the inlet and connectable to the reservoir to allow glue to be circulated from the reservoir into the manifold through the inlet and out of the manifold through the third outlet back to the reservoir. Each valve has a first position in which it directs glue from the inlet out through the corresponding first or second outlet. It also has a second position in which it directs glue from the inlet to the third outlet to be circulated back to the reservoir. A shut-off valve is positioned to selectively close the third outlet to provide increased line pressure for ejecting glue out through the first and second outlets. Preferably, the manifold includes a passageway interconnecting the first and second valves. Each valve, when it is in its first position, directs glue from the passageway out through the corresponding first or second outlet.

Various types of valves are suitable for use in the dispenser. In the preferred embodiment, each valve is a three-way, two-position valve having a ball valve element. A pivot shaft extends from the ball valve element out through an external sidewall of the manifold to an outer end. A lever is secured to the shaft's outer end. A linear actuator is mounted on the manifold and has a movable portion pivotally attached to the lever. The movable portion is extendible and retractable to pivot the lever and the shaft and thereby pivot the valve element.

As noted above, it is anticipated that the dispenser will be used primarily in connection with hot melt adhesives. Therefore, a preferred feature of the dispenser is a manifold that includes internal glue conduits and an internal cavity surrounding the conduits. The conduits interconnect the inlet and the first and second outlets and, if applicable, the third outlet. The manifold includes a hot fluid inlet into the cavity and a hot fluid outlet from the cavity. The fluid inlet and fluid outlet are connectable to a hot fluid source remote from the manifold to provide a source of heat to maintain glue in the conduits within a predetermined range of elevated temperatures. When the manifold includes a passageway interconnecting the first and second valves, the passageway is preferably formed by one of the conduits. The hot fluid is preferably a hot oil circulated between the cavity and a remote reservoir.

In another embodiment of the invention, the manifold defines an interior space for a body of glue. The inlet and the first and second outlets communicate with the space. The dispenser includes first and second cylinders carried by the manifold. Each cylinder has a lower variable volume chamber surrounded by the space. A cylinder sidewall opening provides communication between the space and the chamber. A piston is slidably received in the cylinder and partially defines the chamber. The piston is movable between a first position in which it is above the opening to allow communication between the chamber and interior space, and a second position in which it is adjacent to the opening to block the communication. The first and second valves are operable to open the bottom ends of the lower variable volume chambers of the first and second cylinders, respectively.

The dispenser of the invention may easily be incorporated into automated or partially automated apparatus for installing raised road markers on a roadway. The dispenser may be operated from a location remote from the dispenser manifold and thereby helps avoid the problem of worker safety encountered in previous methods of installing road markers. The system operator may work from a safe remote location removed from dangerous traffic and from the hazards of the high temperatures that are typically required for the adhesives used to secure road markers to a roadway. The structure of the glue dispenser is relatively simple to thereby help maintain low cost of manufacture and maintenance. In addition, the relatively simple structure and operation of the dispenser further decreases costs by minimizing the operator labor required in connection with the use of the dispenser. The safety and cost-saving advantages of the dispenser may be maximized by incorporating the dispenser into an automated installation system that is at least primarily computer controlled and that requires only one or two workers to, for example, drive the vehicle on which the dispenser is mounted and monitor the operation of the system by the computer.

An important feature of the invention is the capability of the dispenser of being operated to dispense glue either from both outlets simultaneously or from only one of the outlets. This versatility of operation allows the dispenser to be used to install either a single line of markers or a double line of markers. For example, it may be used to install a single line between lanes in the same direction or a double center line. The use of the dispenser to install a double line not only greatly increases the efficiency of the installation procedure but also helps increase its accuracy by maintaining a precise distance between the two lines of markers.

The ball valve structure described above is an important feature of the preferred embodiment. The structure is relatively simple and cost efficient and very reliable in operation. In addition, the mounting of the linear actuator on the exterior of the manifold makes it easily accessible for maintenance and allows the dispenser to be readily incorporated into a system.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 1:
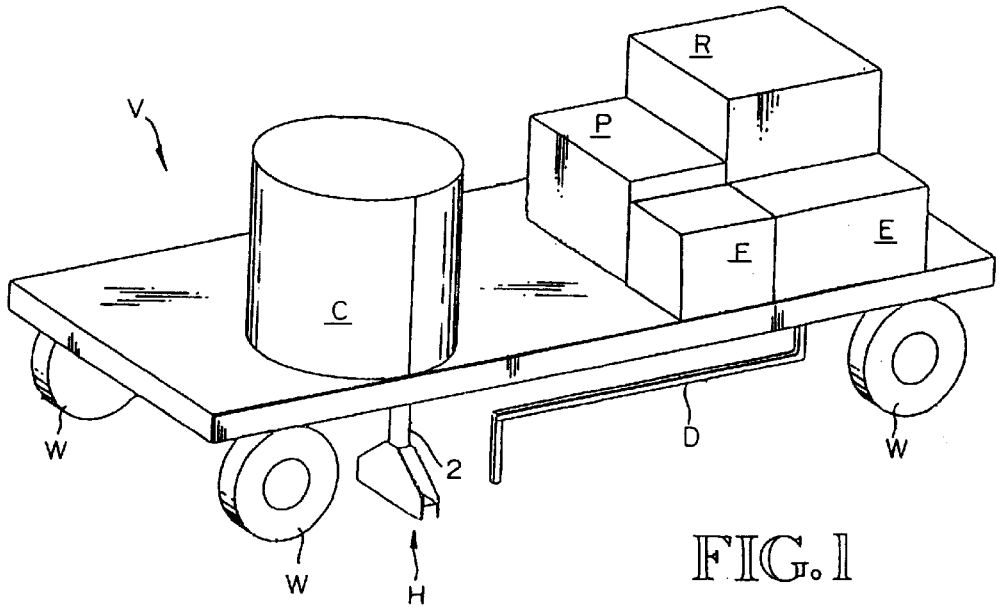
FIG. 1 is a schematic pictorial view of a trailer portion of a vehicle on which elements of automated marker installation apparatus are mounted.
Figure 2:
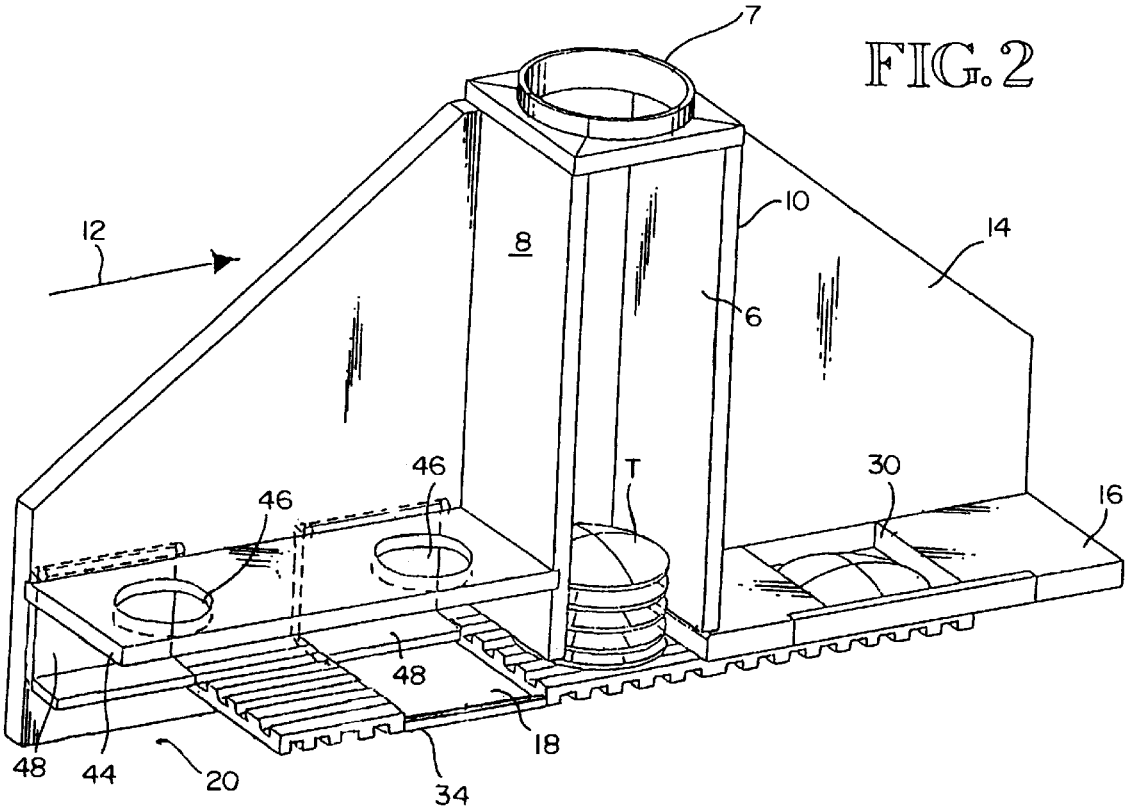
FIG. 2 is an enlarged pictorial view of the installation head shown in FIG. 1, with the foreground wall and actuating rams omitted.

The drawings show apparatus for installing raised road markers on a roadway, including automatic glue dispensing apparatus. The illustrated glue dispensing apparatus is constructed according to the invention and also constitutes the best modes for carrying out the invention currently known to the applicant. The installation apparatus shown in FIGS. 1 and 2 is described more fully and claimed in my above-cited application Ser. No. 08/698,427. The portions of the disclosure of that application not repeated herein are incorporated herein by reference. As shown herein, the installation apparatus includes a carrousel C for delivering road markers to an installation head H.

FIG. 1 shows the trailer portion V of a vehicle having a bed mounted on wheels W to permit the trailer V to be pulled by a cab portion of the vehicle (not shown). Elements of the apparatus are mounted on and under the trailer bed. These elements include the installation head H, an adhesive reservoir R, a glue tube D, and a hot oil reservoir F. They also include an air compressor P and an electrical unit E for powering the other elements. It is anticipated that the apparatus will be used to install road markers using a hot melt bitumen adhesive. In such case, the reservoir R would be provided with heating means powered by the electrical unit E to maintain the bitumen adhesive at the correct installation temperature. Alternatively, the apparatus could be used in connection with a two-part adhesive, such as the adhesive sold under the trademark "EPOXY". The use of both types of adhesives for installing road markers is known in the art.

The glue dispensing apparatus of the invention is preferably used in an automated system designed to permit installation of road markers without stopping the forward movement of the trailer V. To facilitate this procedure, the glue dispenser may be mounted to be movable relative to the trailer V at the same speed as the trailer V but in the opposite direction. The dispenser is connected to the lower end of the glue tube D. At least a portion of the tube is flexible to allow the relative movement.

FIG. 2 shows the installation head H in more detail. The head H may be used in connection with a vertical feed tube 2, as shown in FIG. 1. Road markers are fed downwardly through the vertical tube 2 into a vertical loading chamber 6. The markers may be of various types, such as the round markers T shown in FIG. 2. The markers T are commonly known as "turtles". The chamber 6 is defined by a laterally outer (relative to trailer V) wall 8, a laterally inner wall 10 and opposite laterally extending sidewalls 14. A fitting is provided at the top of the chamber 6 to receive the lower end of the feed tube 2. The fitting 7 shown in FIG. 2 is circular to receive a cylindrical feed tube for round markers T. A square fitting for a square feed tube could also be provided. Such a tube can accommodate either round or square markers.

The installation head has one or more setting stations and preferably has two setting stations. In FIG. 2, the foreground sidewall is omitted to show the portions of the installation head H positioned between the sidewalls 14. The laterally inward direction is indicated in FIG. 2 by the arrow 12. The markers T are moved laterally inwardly and outwardly within the head H by a slide 16 and ultimately to one of two setting stations 18, 20, from which they are set down upon the pavement.

Still referring to FIG. 2, the head H has two loading stations. The first loading station is defined by the loading chamber walls 8, 10, 14 and is located at the bottom of the loading chamber 6. The second loading station 30 is defined by a vertical opening in the slide 16. The slide 16 is slidably mounted on a horizontal installation head floor 34. Thus, the location of the second loading station 30 is movable. The slide 16 is preferably moved horizontally back and forth along the upper surface of the floor 34 by a ram (not shown). The bottoms of the loading chamber walls 8, 10 are spaced above the floor 34 a distance slightly greater that the height of the markers to allow markers to move along the floor 34, one at a time, under the walls 8, 10, into and out from the loading station at the bottom of the loading chamber 6. The height (vertical thickness) of the slide 16 is substantially equal to the height of the markers to allow the slide 16 to slide under the walls 8, 10. The floor 34 has a vertical opening that defines the first setting station 18.

A setting ram (not shown) is provided at each of the setting stations 18, 20. A horizontal mounting wall 44 extends from the outer end of the installation head H to the outer wall 8 of the loading chamber 6, between the sidewalls 14 and above the floor 34. An opening 46 extends vertically through the mounting wall 44 above each of the setting stations 18, 20. The openings 46 are sized to permit the corresponding rams to move downwardly and upwardly through the wall 44 during a setting procedure. Each ram has a housing that is secured to the wall 44. At each setting station 18, 20 there is also provided a pair of opposite bomb bay doors 48. In FIG. 2, the door mounted on the omitted foreground sidewall is not shown.

Road markers that are delivered to the bottom of the loading chamber 6 down through the feed tube 2 are moved laterally within the head H by the slide 16. As noted above, the markers are moved laterally to the setting stations 18, 20 from which they are set down onto the pavement by the setting rams. When a marker is delivered to one of the setting stations 18, 20, it is maintained at a vertical level flush with the top of the floor 34 by the bomb bay doors 48. The bomb bay doors 48 support the marker until the setting ram is activated to force the marker down through the bomb bay doors 48 and onto the pavement.

Figure 3:
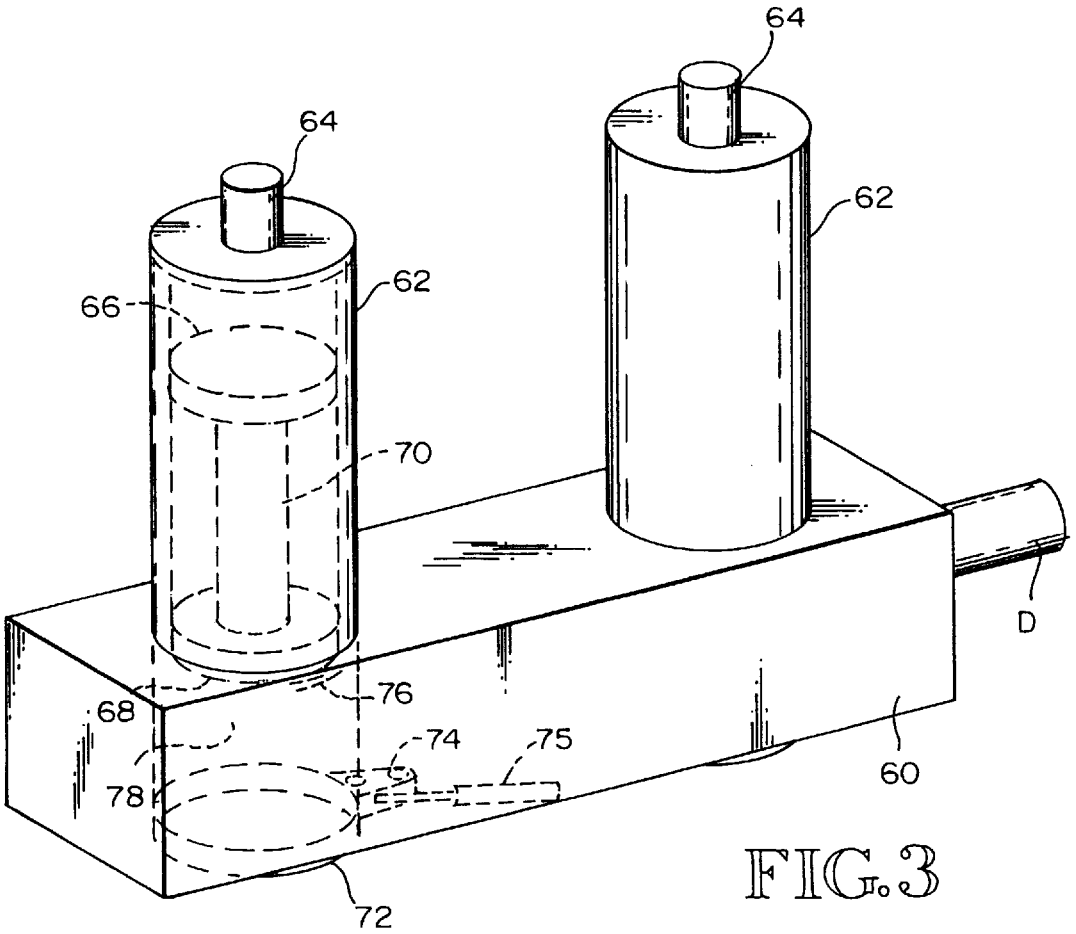
FIG. 3 is a pictorial view of a first embodiment of the glue dispenser of the invention.
Figure 4:
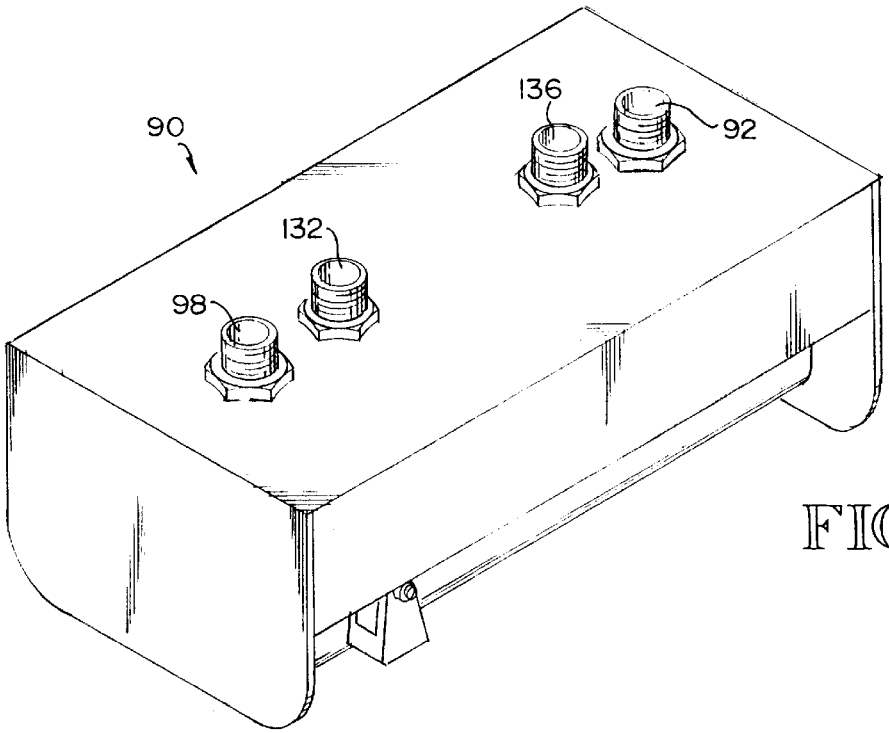
FIG. 4 is a pictorial view of a second embodiment of the glue dispenser of the invention looking down at the top of the dispenser.

FIG. 3 shows a first embodiment of the glue dispensing apparatus of the invention. Referring to FIG. 3, a glue dispensing manifold 60 is designed for use with the double installation head illustrated and described above. Glue dispensers currently in use have a single nozzle and are not adequate for simultaneous dispensing of glue for placement of two side-by-side markers. They also are not designed for dispensing glue in either one of two side-by-side locations. The glue dispenser of the invention can dispense two deposits of glue simultaneously for simultaneous installation of two side-by-side markers. It also can dispense a single deposit of glue for installation of a single marker in either of the side-by-side positions, in accordance with the needs of a particular situation.

Still referring to FIG. 3, the manifold 60 has a pair of spaced apart air ram cylinders 62 mounted thereon. The cylinders 62 are spaced apart the same distance that the setting stations 18, 20 in the installation head are spaced apart and that road markers are typically spaced apart in a double centerline installation. Each cylinder 62 has an air inlet 64 for receiving a coupling to receive compressed air from the compressor P. A double-headed piston member is slidably positioned inside the cylinder 62. The piston member has an upper air ram actuator piston 66 and a lower ejection piston 68 spaced apart from the actuator piston 66 by a rod 70. A lower nozzle is formed by an opening in the bottom wall of the manifold 60 under each of the cylinders 62. Each nozzle has a nozzle port cover 72 with a projecting arm 74. A second smaller pneumatic cylinder 75 is attached to the arm 74 to open and close the nozzle port by pivoting the cover 72 horizontally along the bottom of the manifold 60. This movement causes the cover/arm assembly 72, 74 to act as a valve to control flow of glue out through the nozzle outlet.

Heated bituminous adhesive is supplied into the manifold 60 through the glue tube D. Electrical heating tape or a hot oil jacket are provided around the manifold body to maintain the temperature of the adhesive therein and reheat the adhesive, as needed. The interior of the manifold 60 is filled with adhesive. The portions of the manifold interior inside the lower portions of the cylinders 62 form variable volume chambers 78 and are filled through openings in such lower portions. The openings in each cylinder 62 are preferably in the form of two circumferential grooves 76 in the cylinder wall just below the position of the ejection piston 68 shown in FIG. 3. The grooves 76 and the axial thickness of the piston 68 are dimensioned so that the piston 68 covers the grooves 76 when it moves downwardly from the FIG. 3 position. The grooves 76 remain blocked by the piston 68 until the piston 68 returns to the FIG. 3 position.

In operation, the manifold 60 is brought into position above the location where glue is to be dispensed by movement of the vehicle. When the manifold 60 is in position, the control system signals valves to open to deliver pressurized air to one or both of the cylinders 62. The pressurized air enters inlet 64 and acts on actuator piston 66 to move the piston member downwardly. The ejection piston 68 acts on the body of glue in the manifold 60 to eject glue out through the nozzle. At the same time, the smaller air cylinder pivots the nozzle cover 72 the appropriate amount to allow the desired amount of glue to be released through the nozzle down onto the pavement. The pivotal mounting of the cover 72 is an over-center arrangement to provide quick snap action opening and closing of the cover 72 and thereby assure dispensing of the correct amount of glue. The use of the manifold makes it possible to have sufficient glue in position over the deposit location to deposit two bodies of glue simultaneously, if required. It also allows the selected deposit of glue in only one of two side-by-side locations, if that is required. After the glue at a particular location has been deposited, the manifold is refilled through the glue tube D so that there is a full supply at hand when the next location is reached.

Figure 5:
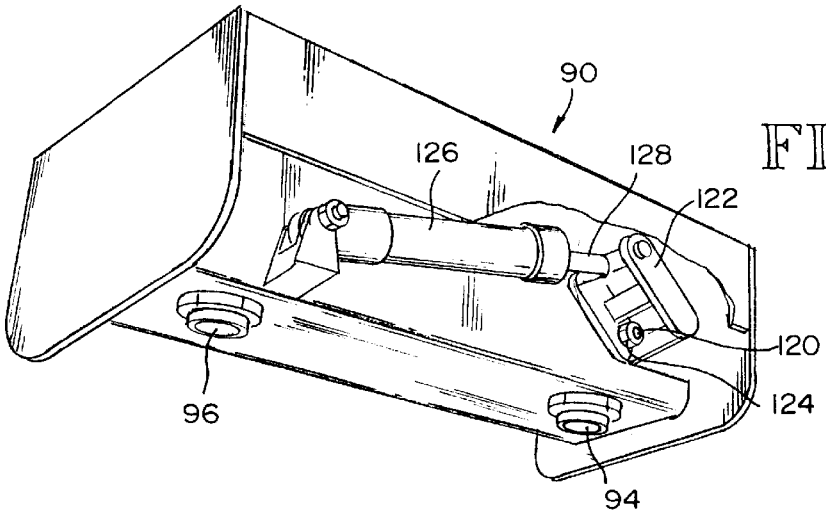
FIG. 5 is a pictorial view looking up toward the bottom of the dispenser shown in FIG. 4, with foreground portions cut away to show the valve actuating mechanism in a first position.
Figure 6:
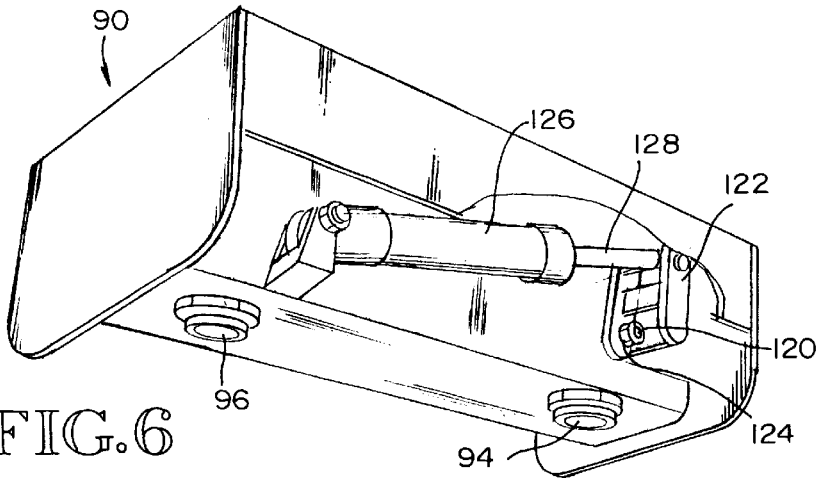
FIG. 6 is like FIG. 5 except that it shows the valve actuating mechanism in a second position.
Figure 7:
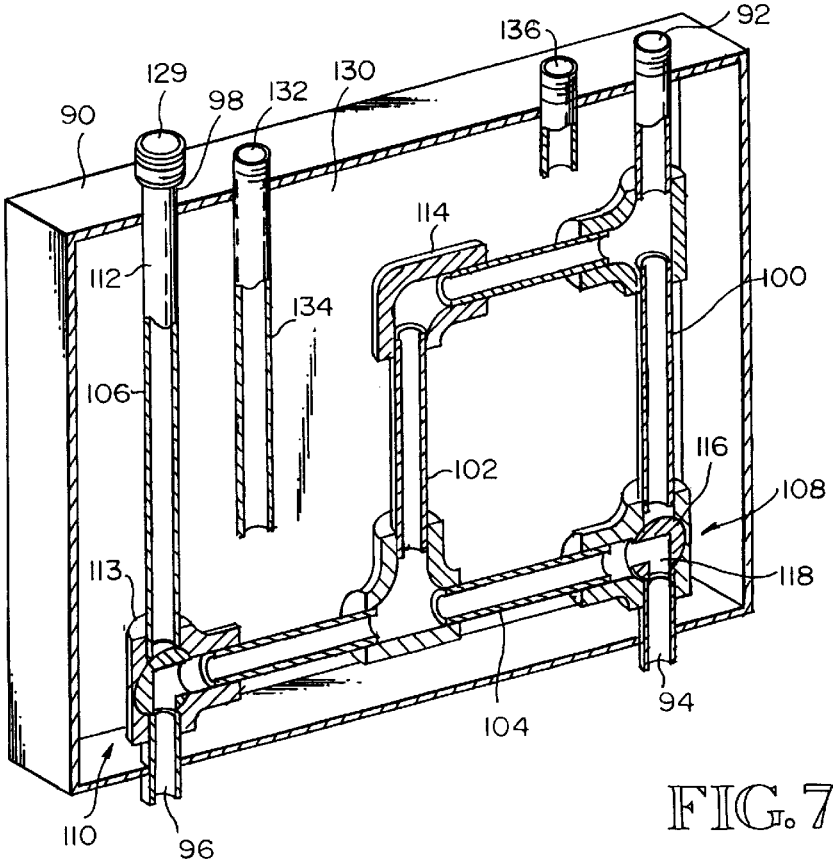
FIG. 7 is a partially schematic pictorial view of the dispenser shown in FIGS. 4–6, with parts shown in section and with the valves in a first glue dispensing position.
Figure 8:
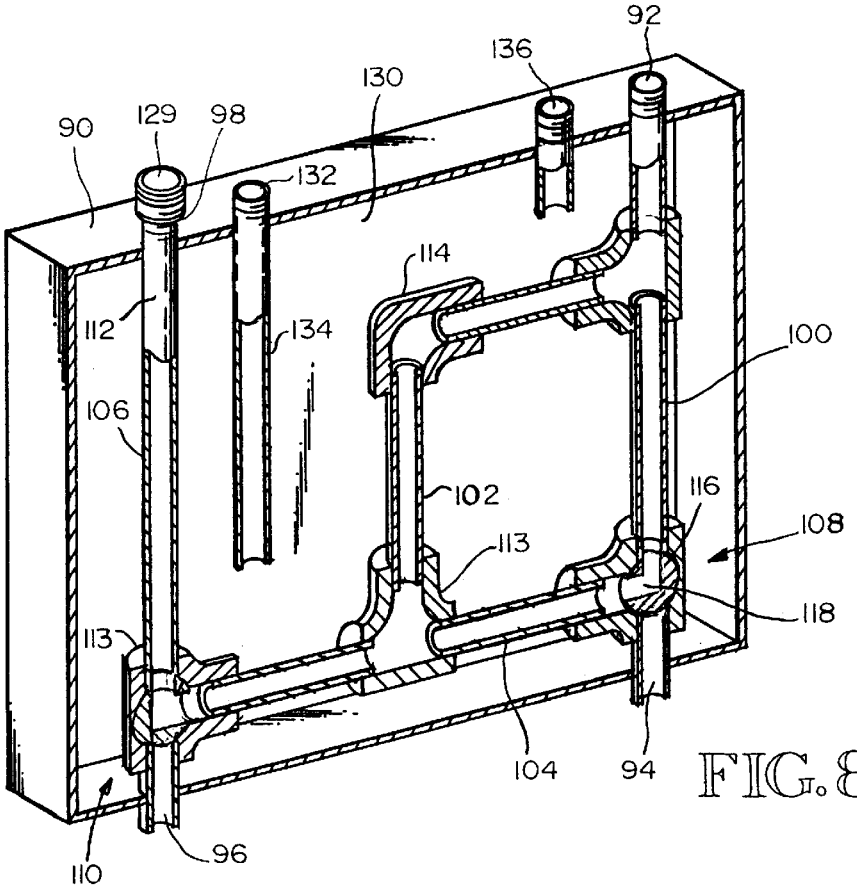
FIG. 8 is like FIG. 7 except that it shows the valves in a second position for recirculating glue through the dispenser back to the reservoir.

FIGS. 4–8 show another embodiment of the glue dispensing apparatus that is currently the preferred embodiment. The apparatus includes a manifold 90, shown in FIGS. 4–6 and partially schematically in FIGS. 7 and 8. The manifold has a glue inlet 92 and three glue outlets 94, 96, 98 communicating with the inlet 92. Movement of glue through the manifold 92 is directed through a plurality of conduits, as shown in FIGS. 7 and 8. A first conduit 100 extends downwardly from the inlet 92 to the first outlet 94. A second conduit 102 branches off from the first conduit 100 and extends along an L-shaped path horizontally and then downwardly to a lower horizontal conduit 104. A fourth conduit 106 extends vertically between the second and third outlets 96, 98. First and second valves 108, 110 control opening and closing of the first and second outlets 94, 96, respectively. The passageway formed by the third conduit 104 extends between the two valves 108, 110.

The conduits are preferably formed by sections of tubes 112 joined by three-way couplings 113 and two-way coupling 114. The tubes 112 and couplings 113, 114 may be made from various materials. The primary consideration is the ability of the material to maintain its integrity during prolonged exposure to the elevated temperatures required for the glue. In FIGS. 7 and 8, the tubes 112 and couplings 113, 114 are shown generically as being metal. However, it is anticipated that plastic components 112, 113, 114 would generally be preferable to minimize the weight of the apparatus. The preferred construction of tubes and couplings shown in FIGS. 7 and 8 has the advantages of being relatively easy and cost effective to manufacture and maintain.

Referring to FIGS. 7 and 8, each valve 108, 110 includes a ball valve element 116. The element 116 is substantially spherical and has an L-shaped passageway 118 extending therethrough. The element 116 is positioned inside a three-way coupling 113 to provide a two-position, three-way valve. The coupling 113 for the first valve 108 interconnects conduit 100, conduit 104, and a short conduit extending downwardly from the coupling to form the first outlet 94. The valve 108 has a first position in which the passageway 118 in the element 116 communicates conduit passageway 104 with the outlet 94 to thereby direct glue moving into the dispenser through inlet 92 out through outlet 94. This first position is illustrated in FIG. 7. The valve 108 also has a second position illustrated in FIG. 8. In this second position, the valve passageway 118 interconnects conduit 100 with passageway 104 to direct glue from inlet 92 toward the third outlet 98 for recirculation back to the reservoir R.

The second valve 110 similarly has a first glue dispensing position and a second glue recirculating position, shown in FIGS. 7 and 8, respectively. Referring to FIG. 7, the valve passageway 118 communicates the second outlet 96 with the passageway 104 to direct glue from inlet 92 out through the outlet 96. Referring to FIG. 8, the valve passageway 118 communicates the passageway 104 with conduit 106 to direct glue out through the third outlet 98 for recirculation.

The valve elements 116 are moved between their two positions by means of the actuating mechanism illustrated in FIGS. 5 and 6. A pivot shaft 120 extends from the element 116 out through an external sidewall of the manifold housing to an outer end. A lever 122 is secured to the outer end of the pivot shaft 120. A lock nut 124 prevents relative rotation between the shaft 120 and the lever 122. A pneumatic cylinder 126 pivots the lever 122 between first and second positions, shown in FIGS. 5 and 6, to thereby pivot the element 116 between its first and second positions. A piston rod 128 extends from the cylinder 126 and is pivotally attached to the lever 122. The rod 128 is extendible and retractable to pivot the lever 122.

Glue reservoirs that are commercially available provide line pressure for glue flowing out of the reservoir. Therefore, the glue entering the manifold 90 through the inlet 92 is under some pressure. However, due to the viscous nature of the bituminous adhesive commonly used to secure road markers, the flow pressure of the adhesive provided by the reservoir is not sufficient to cause ejection of the adhesive from an open port. In order to provide increased pressure for proper ejection of the adhesive, the third outlet 98 is provided with a shut-off valve 129, shown schematically in FIGS. 7 and 8. The valve 129 may be of various known types such as a three-way ball valve. Before the flow control valves 108, 110 are moved into their first positions shown in FIG. 7, the shut-off valve 129 is closed to interrupt flow of glue out of the manifold 90 through the third outlet 98 and back to the reservoir R. Closing the valve 129 creates line pressure in the dispenser conduits 100, 102, 104, 106. The line pressure forces the adhesive out from the ports 94, 96 when the valves 108, 110 are opened. The result is quick ejection of adhesive in sufficient volume to secure a road marker to the roadway. Once the adhesive has been ejected, the shut-off valve 129 is opened to permit recirculation of the adhesive for the purpose described below.

Each of the embodiments of the invention preferably includes means for maintaining glue in the manifold within a predetermined range of elevated temperatures. This predetermined range is based on the characteristics of the type of glue being used. The range is the range at which the glue is at a suitable viscosity for dispensing out through the manifold to form a deposit on a roadway that will secure a road marker to the roadway.

In the operation of the dispenser in an automated road marker installation system, such as that shown in FIG. 1, glue is provided to the dispenser manifold from a glue reservoir R down through a glue tube D. Commercially available glue reservoirs have heating mechanisms for maintaining the glue within its operating range. The currently preferred type of reservoir or "glue pot" for use with the dispenser of the invention is a Super Shot 60 (trademark) or a Super Shot 250 (trademark) sold by Crafco, Inc., Chandler, Ariz. These two glue pots are of a type having an adjustable gear drive motor to feed glue under pressure into a glue tube. The amount of feed pressure can be adjusting by adjusting the motor. The glue pot maintains the glue in the reservoir at an operating temperature. However, glue in the glue tube D and in the manifold of the apparatus of the invention can cool below the operating range unless additional means is provided for maintaining it within the range.

In the preferred embodiment shown in FIGS. 4–8, the manifold housing defines an internal cavity 130 surrounding the conduits 100, 102, 104, 106 through which glue moves in and out of the manifold 90. The manifold 90 has a hot fluid inlet 132 and a hot fluid outlet 136, both of which communicate with the internal cavity 130. The fluid inlet 132 and fluid outlet 136, in use, are connected to a hot fluid source remote from the manifold 90. Preferably, the inlet 132 and outlet 136 are connected to a hot oil reservoir F. This provides a source of heat to maintain glue in the conduits 100, 102, 104, 106 within the predetermined range of elevated temperatures.

As can be seen in FIGS. 7 and 8, the oil inlet 132 communicates with the cavity 130 via an inlet tube 134 that extends downwardly into the cavity 130 for a distance about 60% of the vertical height of the cavity 130. The tube connected to and forming the oil outlet 136 is much shorter. The elongated inlet tube 134 for the inlet 132 helps ensure that the temperature of the hot oil circulating through the cavity 130 is substantially constant throughout all portions of the cavity 130. The oil is circulated by a suitable pump down from the hot oil reservoir F into the manifold through the inlet 132 around and through the cavity 130 and out the outlet 136 back to the reservoir F. The reservoir F is provided with a conventional heater and thermostat to maintain it at a desired temperature. In the preferred embodiment, the reservoir F is part of the glue pot heating system, for example, the heating system of a Crafco Super Shot 60 (trademark) glue pot.

The circulating of hot oil through the internal cavity 130 and the recirculating of undispensed glue from the manifold 90 back to the glue reservoir R both contribute toward the accurate maintenance of the temperature of the glue in the manifold within its predetermined operating temperature range. The maintenance of the operating temperature helps ensure that the functioning of the first and second glue outlets 94, 96 as dispenser nozzles is maintained. The maintenance of the desired temperature prevents the outlet nozzles 94, 96 from becoming clogged and, in effect, causes the nozzles 94, 96 to be self-cleaning.

Figure 9:
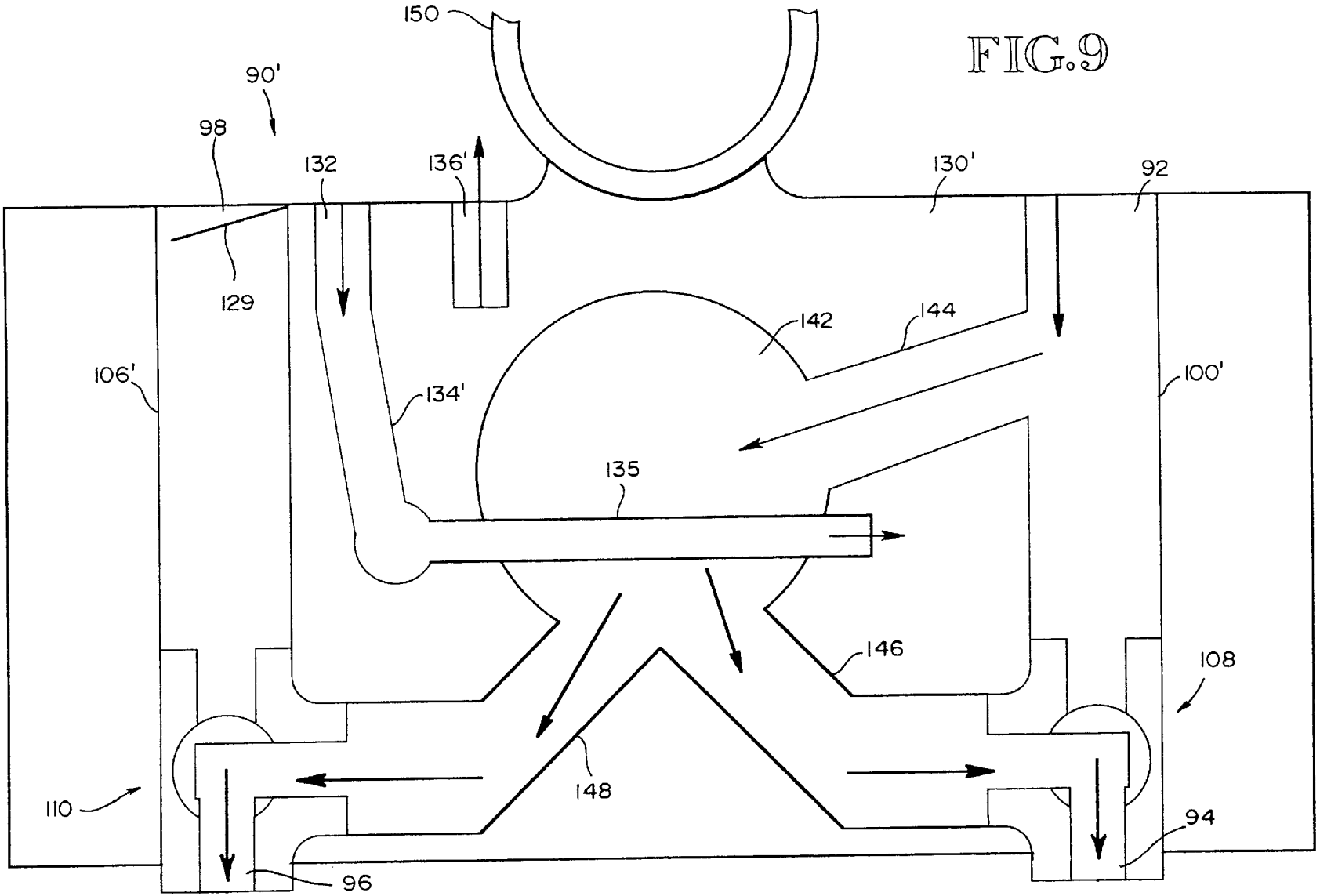
FIG. 9 is a schematic view of a third embodiment of the glue dispenser similar to that shown in FIGS. 4–8.

FIG. 9 shows a third embodiment of the glue dispensing apparatus that is similar to the second embodiment shown in FIGS. 4–8. In FIG. 9, elements of the apparatus that are the same as those shown in FIGS. 4–8 are given the same reference numerals as in FIGS. 4–8. Elements that are similar and perform substantially the same function are given the same reference numeral with the addition of a prime symbol. Referring to FIG. 9, the manifold 90' of the third embodiment includes a glue inlet 92 and first, second, and third glue outlets 94, 96, 98. It also includes vertical glue passageways 100', 106' extending between inlet 92 and first outlet 94, and between second and third outlets 96, 98, respectively. First and second valves 108, 110 are positioned as in FIGS. 7 and 8 to control flow of glue out through the first and second outlets 94, 96, respectively. The third outlet 98 is provided with a shut-off valve 129.

The major differences between the embodiment of FIG. 9 and the embodiment of FIGS. 4–8 are the configuration of the pathway of glue from the inlet 92 and conduit 100' to the valves 108, 110. In the embodiment of FIG. 9, the glue flows from conduit 100' to an enlarged spherical internal center space 142 via a conduit 144. First and second generally L-shaped conduits 146, 148 extend from the space 142 to the first and second valves 108, 110, respectively. These two conduits 146, 148 and the center space 142 form the passageway interconnecting the first and second valves 108, 110.

The differences in the configuration of the glue pathways result in differences in the configuration of the internal cavity 130'. Because of the differences in the configuration of the internal cavity 130' and the relatively large body of glue in the center space 142, the inflow of hot oil through the oil inlet 132 is directed into the cavity 130 through a differently configured inlet conduit 134', 135. The inflowing oil extends downwardly through a vertical leg 134' of the inlet conduit and then through a horizontal leg 135 of the inlet conduit that extends horizontally through the space 142 and out into the cavity 130' on the side of the space 142 opposite the vertical leg 134'. This arrangement helps ensure a uniform temperature of the glue in the space 142. Since the hot oil is directed toward the side of the cavity 130' opposite the oil inlet 132, the oil outlet 136' is repositioned to be adjacent to the inlet 132.

FIG. 9 also shows an additional feature of a tubular mounting ring 150 for the manifold 90'. This ring may be secured, for example, to a sliding tube that slides forwardly and rearwardly on a cylindrical mounting shaft fixed relative to the vehicle on which the apparatus is mounted. Such an arrangement permits movement of the dispenser 90' relative to the vehicle while the vehicle is moving along a roadway to allow the glue to be dispensed from the manifold 90' while the manifold 90' is stationary relative to the roadway. This allows the vehicle carrying the road marker installation apparatus to move continuously along an installation line while ensuring that the deposits of glue for the road markers are correctly positioned and are of a desired configuration corresponding to the configuration of the outlets 94, 96. This configuration is generally circular for installation of round road markers or square road markers. Other configurations to suit noncircular markers might also be provided.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A glue dispenser for use in apparatus for installing raised road markers on a roadway, said dispenser comprising:

a manifold having an inlet for glue, and first and second outlets communicating with said inlet; and first and second valves controlling opening and closing of said first and second outlets, respectively; said valves being operable both simultaneously and independently of each other to permit glue to be dispensed from only one of said outlets or from both of said outlets simultaneously, as needed;

said outlets being spaced apart a distance equal to a desired distance between lines of markers in a double line installation.

2. The dispenser of claim 1, further comprising means for maintaining glue in said manifold within a predetermined range of elevated temperatures.

3. The dispenser of claim 1, wherein said inlet is connectable to a glue reservoir remote from said manifold; said manifold has a third outlet communicating with said inlet and connectable to said reservoir to allow glue to be circulated from the reservoir into said manifold through said inlet and out of said manifold through said third outlet back to the reservoir; each said valve has a first position in which it directs glue from said inlet out through the corresponding one of said first and second outlets, and a second position in which it directs glue from said inlet to said third outlet; and said dispenser has a shut-off valve positioned to selectively close said third outlet to provide increased line pressure for ejecting glue out through said first and second outlets.

4. The dispenser of claim 3, wherein said manifold includes a passageway interconnecting said first and second valves; and each said valve in its first position directs glue from said passageway out through the corresponding one of said first and second outlets.

5. The dispenser of claim 4, in which each said valve is a three-way, two-position valve having a ball valve element, a pivot shaft extending from said ball valve element out through an external sidewall of said manifold to an outer end, a lever secured to said outer end, and a linear actuator mounted on said manifold and having a movable portion pivotally attached to said lever; said movable portion being extendible and retractable to pivot said lever and said shaft and thereby pivot said valve element.

6. The dispenser of claim 5, wherein said manifold includes internal glue conduits interconnecting said inlet and said first, second, and third outlets, one of said conduits forming said passageway, an internal cavity surrounding said conduits, a hot fluid inlet into said cavity, and a hot fluid outlet from said cavity; said fluid inlet and said fluid outlet being connectable to a hot fluid source remote from said manifold to provide a source of heat to maintain glue in said conduits within a predetermined range of elevated temperatures.

7. The dispenser of claim 4, wherein said manifold includes internal glue conduits interconnecting said inlet and said first, second, and third outlets, one of said conduits forming said passageway, an internal cavity surrounding said conduits, a hot fluid inlet into said cavity, and a hot fluid outlet from said cavity; said fluid inlet and said fluid outlet being connectable to a hot fluid source remote from said manifold to provide a source of heat to maintain glue in said conduits within a predetermined range of elevated temperatures.

8. The dispenser of claim 3, wherein said manifold includes internal glue conduits interconnecting said inlet and said first, second, and third outlets, an internal cavity surrounding said conduits, a hot fluid inlet into said cavity, and a hot fluid outlet from said cavity; said fluid inlet and said fluid outlet being connectable to a hot fluid source remote from said manifold to provide a source of heat to maintain glue in said conduits within a predetermined range of elevated temperatures.

9. The dispenser of claim 3, in which each said valve is a three-way, two-position valve having a ball valve element, a pivot shaft extending from said ball valve element out through an external sidewall of said manifold to an outer end, a lever secured to said outer end, and a linear actuator mounted on said manifold and having a movable portion pivotally attached to said lever; said movable portion being extendible and retractable to pivot said lever and said shaft and thereby pivot said valve element.

10. The dispenser of claim 9, wherein said manifold includes internal glue conduits interconnecting said inlet and said first, second, and third outlets, an internal cavity surrounding said conduits, a hot fluid inlet into said cavity, and a hot fluid outlet from said cavity; said fluid inlet and said fluid outlet being connectable to a hot fluid source remote from said manifold to provide a source of heat to maintain glue in said conduits within a predetermined range of elevated temperatures.

11. The dispenser of claim 1, wherein said manifold includes internal glue conduits interconnecting said inlet and said first and second outlets, an internal cavity surrounding said conduits, a hot fluid inlet into said cavity, and a hot fluid outlet from said cavity; said fluid inlet and said fluid outlet being connectable to a hot fluid source remote from said manifold to provide a source of heat to maintain glue in said conduits within a predetermined range of elevated temperatures.

12. The dispenser of claim 11, in which each said valve is a three-way, two-position valve having a ball valve element, a pivot shaft extending from said ball valve element out through an external sidewall of said manifold to an outer end, a lever secured to said outer end, and a linear actuator mounted on said manifold and having a movable portion pivotally attached to said lever; said movable portion being extendible and retractable to pivot said lever and said shaft and thereby pivot said valve element.

13. The dispenser of claim 1, wherein said manifold defines an interior space for a body of glue, said inlet and said first and second outlets communicating with said space; and said dispenser includes first and second cylinders carried by said manifold, each said cylinder having a lower variable volume chamber surrounded by said space and a sidewall opening providing communication between said space and said chamber, and a piston slidably received in said cylinder and partially defining said chamber, said piston being movable between a first position in which it is above said opening to allow said communication and a second position in which it is adjacent to said opening to block said communication; said first and second valves being operable to open a bottom end of said chamber of said first and second cylinders, respectively.

* * * * *